US008371050B2

(12) United States Patent
Kirkpatrick et al.

(10) Patent No.: US 8,371,050 B2
(45) Date of Patent: Feb. 12, 2013

(54) FRAME/TEMPLATE FOR SECURING A VIDEO SCREEN TO A GOLF BAG OR OTHER ITEM AND METHOD THEREFOR

(76) Inventors: Joseph F. Kirkpatrick, Apache Junction, AZ (US); Anne M Kirkpatrick, Apache Junction, AZ (US); Andrew Pinkerton, Redwood City, CA (US)

( * ) Notice: Subject to any disclaimer, the term of this patent is extended or adjusted under 35 U.S.C. 154(b) by 357 days.

(21) Appl. No.: 12/775,374

(22) Filed: May 6, 2010

(65) Prior Publication Data

US 2010/0299977 A1 Dec. 2, 2010

Related U.S. Application Data

(60) Provisional application No. 61/181,819, filed on May 28, 2009.

(51) Int. Cl.
*G09F 11/00* (2006.01)

(52) U.S. Cl. ..... 40/1; 40/915; 40/606.03; 206/315.8

(58) Field of Classification Search ..... 190/122, 190/124, 127; 206/315.3, 320, 720; 40/312, 40/606.03, 1; 348/838
See application file for complete search history.

(56) References Cited

U.S. PATENT DOCUMENTS

| | | | | |
|---|---|---|---|---|
| 6,220,432 | B1 * | 4/2001 | Tan | 206/315.3 |
| 6,749,062 | B1 * | 6/2004 | Meissner | 206/315.3 |
| 7,345,578 | B2 * | 3/2008 | Holt et al. | 340/309.7 |
| 7,451,861 | B2 * | 11/2008 | Bhavnani | 190/107 |
| 2004/0026280 | A1 * | 2/2004 | Herold | 206/315.3 |
| 2007/0199851 | A1 * | 8/2007 | Yau | 206/472 |
| 2009/0021654 | A1 * | 1/2009 | Jones | 348/838 |
| 2009/0107878 | A1 * | 4/2009 | Daley, III | 206/576 |
| 2009/0152144 | A1 * | 6/2009 | Anderson et al. | 206/315.3 |
| 2009/0236247 | A1 * | 9/2009 | Daley, III | 206/320 |
| 2009/0261004 | A1 * | 10/2009 | Davidson | 206/315.3 |
| 2010/0050485 | A1 * | 3/2010 | Forte et al. | 40/1.5 |
| 2010/0265067 | A1 * | 10/2010 | Keays | 340/568.6 |

* cited by examiner

*Primary Examiner* — James Kramer
*Assistant Examiner* — Christopher e Veraa
(74) *Attorney, Agent, or Firm* — Weiss & Moy, P.C.; Jeffrey D. Moy

(57) ABSTRACT

A device for displaying advertisements has a plate member. An opening is formed in the plate member, wherein the opening is sized to fit a display screen of a desired dimension. Support arms are coupled to the plate member for securing the device to a storage device to which the device is installed.

19 Claims, 3 Drawing Sheets

FRAME/TEMPLATE FOR SECURING A VIDEO SCREEN TO A GOLF BAG OR OTHER ITEM AND METHOD THEREFOR

RELATED APPLICATIONS

This application is related to provisional application Ser. No. 61/181,819 filed May 28, 2009, entitled "A FRAME/TEMPLATE FOR A MULTI MEDIA BILLBOARD ON PROFESSIONAL GOLF BAGS AND OTHER SPORTS RELATED ACCESSORIES" in the name of the same inventors and is incorporated by reference. The present application claims the benefit of the aforementioned provisional application.

FIELD OF THE INVENTION

This invention relates to multimedia displays and, more specifically, to a frame and or template for installing one or more video screens on a golf bag, suit case, or other type of carrying case.

BACKGROUND OF THE INVENTION

The golfing industry is one of the largest sport industries in the world. Golf operations extend from local equipment shops to driving ranges, to public golf courses, to private country clubs. However, advertising on the golf course is extremely limited. Currently the advertising at most golf courses and on the golf tours of the world are fixed advertisements and brand marketing in stationary locations or on players clothing, bags, and the like.

Unfortunately, as stated above, most advertisements on the golf course are fixed in location. Further, advertisements on players clothing and bags are static and cannot be changed. None of the devices described above taps into available advertising streams by providing for movable and or dynamic advertisements.

Therefore, a need existed to provide a system and method to overcome the above problem.

SUMMARY OF THE INVENTION

In accordance with one embodiment, a device for displaying advertisements is disclosed. The device has a plate member. An opening is formed in the plate member, wherein the opening is sized to fit a display screen of a desired dimension. Support arms are coupled to the plate member for securing the device to a storage device to which the device is installed.

In accordance with one embodiment, a device for displaying advertisements on a piece of baggage is disclosed. The device has a top frame member and a bottom frame member, wherein the top frame member and bottom frame define a shape of the piece of baggage. A plurality of support arms is coupled to the top and bottom frame members. A plurality of plate members is coupled to at least one of the support arms. An opening is formed in the plate members, wherein the opening is sized to fit a display screen of a desired dimension.

The present invention is best understood by reference to the following detailed description when read in conjunction with the accompanying drawings.

BRIEF DESCRIPTION OF THE DRAWINGS

Common reference numerals are used throughout the drawings and detailed description to indicate like elements.

DETAILED DESCRIPTION

Figure 1:
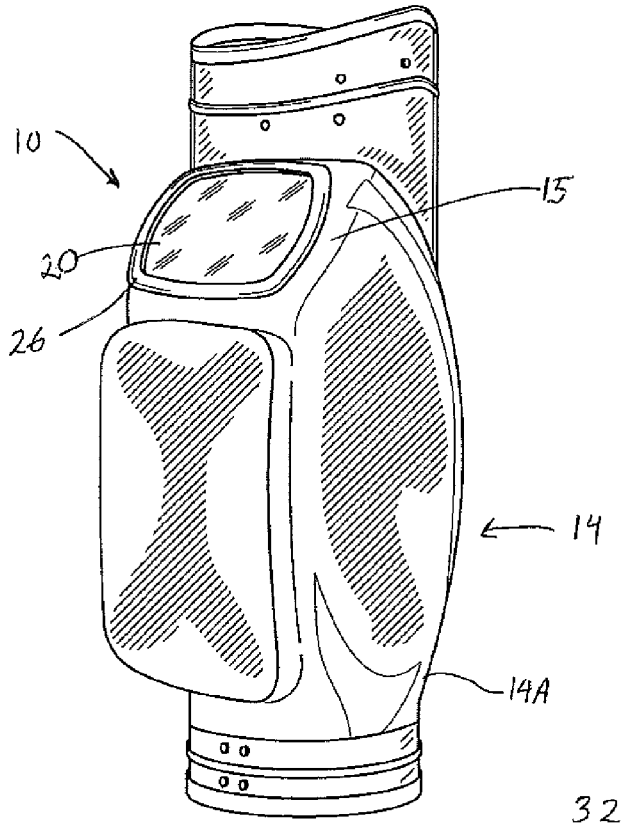
FIG. 1 is a perspective view of one embodiment of a device for securing a video screen used in combination with a golf bag.
Figure 2:
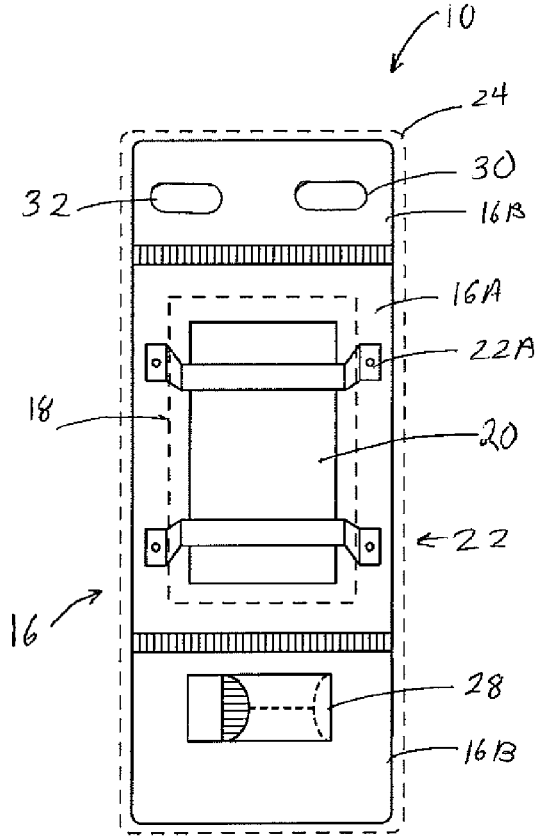
FIG. 2 is a magnified cross-sectional side view of the device shown in FIG. 1.
Figure 3:
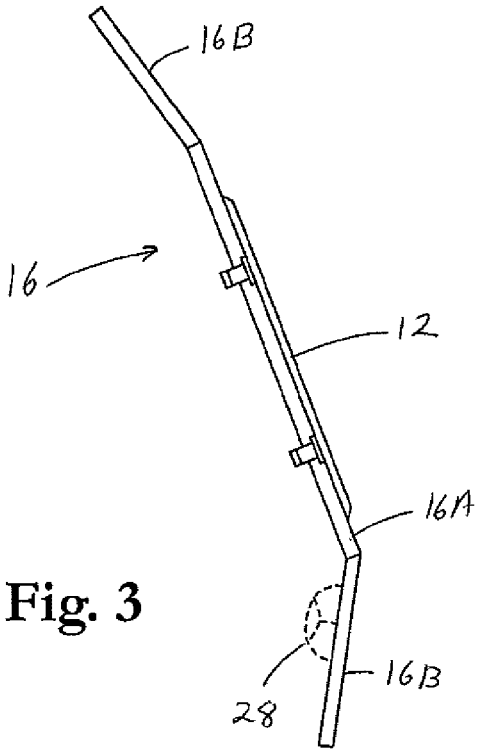
FIG. 3 is a magnified bottom view of the device of FIG. 1.

Referring to FIGS. 1-3, a device 10 for securing a video display screen 20 (hereinafter display screen 20) to a golf bag, suit case, or other type of carrying case (hereinafter bag 14) is shown. In the embodiment shown in FIGS. 1-3, the device 10 is shown installed on a golf bag 14A. The description below will be discussed in relation to a golf bag 14A. However, the device may be installed in other types of carrying and or wheeled cases without departing from the spirit and scope of the present invention.

As shown in FIGS. 1-3, the device 10 is installed in a golf bag 14A. The device 10 may allow a user to install the display screen 20 on the golf bag 14A. This may allow advertisers to increase exposure in both the amount of information the advertisers provide to the consumer or patrons of sporting events, by allowing the advertisements to be seen as they move throughout the field of play as well as outside the venue. With the implementation of the device 10, the display screen 20 may be installed into existing golf bags 14A. This allows the patrons and the TV viewers to see advertisements as the players work their way throughout the courses, practice facilities and outside the venues during interviews and beyond.

The device 10 has a frame 16. The frame 16 is used to mount a display screen 20 to the golf bag 14A. The frame 16 may be mounted anywhere on the golf bag 14A. In the present embodiment, the frame 16 may mounted to a storage compartment 15 of the golf bag 14A.

The frame 16 may be formed of a light weight but sturdy material. For example, the frame 16 may be comprised of a light weight metal such as aluminum or titanium, or light weight plastic material. The listing of the above is given as examples and should not be seen in a limiting manner.

The frame 16 may be comprised of an approximately planer plate member 16A. The plate member 16A may be formed of a thin sheet of aluminum, plastic, or the like. The plate member 16A may have an opening 18 formed therein. In general, the opening 18 may be formed in a central area of the plate member 16A. The opening 18 is sized to allow the display screen 20 to be mounted therein.

The display screen 20 may be a Liquid Crystal Display (LCD), a Light Emitting Diode (LED) display, an Organic Light Emitting Diode (OLED) display or the like. The listing of the above is given as an example and should not be seen in a limiting manner. The display screen 20 may be of various sizes. The opening 18 may be sized to conform to the size and depth of the display screen. In accordance with one embodiment, the display screen may range in width from 4 to 12 inches, and may have a height ranging from 2.5 to 15 inches, with a depth of 0.25 to 2.25 inches, and varying in weight from 8 to 80 ounces. The display screen 20 may have various resolutions. In accordance with one embodiment, the display screen may have a resolution of 320×640 to 1920×1080.

The display screen 20 may be used to show different advertisements. The advertisements may be static or dynamic ads.

The display screen 20 may be used to show a plurality of different advertisements on a rotating basis wherein different ads may be shown after a predetermined time frame.

The display screen 20 may have a memory storage device 30. The memory storage device 30 may be built in to the display screen 20, an external device or the like. The memory storage device may be a device such as a CF card, an SD card, an XD card, MMC card, MS card, MSpro card, a USB device or the like. The listing of the above is given as an example and should not be seen in a limiting manner. The memory storage device may be used to store different advertisements to be shown on the display screen 20. The memory storage device 30 may be used to store photo files such as but not limited to: JPEG, BMP, TIFF, PNG, GIF and the like; video files such as but not limited to MJPEG, MPEG1, MPEG2 , MPEG4, AVI, WMV, MOV, and the like; audio files such as but not limited to: MP4, WAV, MP3, and the like. Speakers or the like may be built in to the display screen 20 or external to the display screen 20. The speakers may be used to play any audio files or audio on the video and or picture files. In accordance with one embodiment, the display screen is a touch screen. Thus, a user may use the touch screen to access the different advertisements to be shown on the display screen 20 and or for other purposes.

The display screen 20 may have a built-in accelerometer 32. The built-in accelerometer 32 may be used to sense position, vibration and shock on the display screen 20. By sensing position, the accelerometer 32 may be used to rotate the advertisement on the display screen 20 based on the position of the golf bag 14A.

A power source 28 may be coupled to the display screen 20. The power source 28 may be coupled to a back surface of the frame 16 as shown in FIG. 3. The power source 28 may be used to illuminate the display screen 20. The power source 28 may be battery, rechargeable battery, a solar panel device, combinations thereof or the like.

One or more display attachment devices 22 may be used to secure the display screen 20 to the plate member 16A. The display attachment devices 22 maybe any type of securing device which is able to secure the display screen 20 to the plate member 16A. In the embodiment shown in FIGS. 2-3, the attachment device 22 is a bracket 22A. The bracket 22A may be a U shaped bracket which fits behind the display screen 20 to secure the display screen 20 to the plate member 16A. In the embodiment shown in FIGS. 2-3, a pair of brackets 22A may be used. However, this is shown as an example and should not be seen in a limiting manner. The brackets 22A may be aluminum, hook and loop material, rubber, lightweight plastic, magnets, or the like. The listing is given as an example and should not be seen in a limiting manner.

Extending from two ends of the plate member 16A may be a pair of support arms 16B. The support arms 16B may be used to secure the frame 16 to the golf bag 14A. In the present embodiment, the support arms 16B may extend down and away from the plate member 16A. By extending down and away from the plate member 16A, the support arms 16B may be used to elevate the plate member 16A and thus the display screen 20 to the plate member 16A. Further, by extending down and away from the plate member 16A, frame 16 is contoured to conform to the shape of the golf bag 14A.

The frame 16 may be secured to the golf bag 14A in a plurality of different manners. Connectors may 24 may be used to secure the frame 16 may be secured to the golf bag 14A. The connectors 24 may be double sided tape, hook and loop material, snaps, magnets, or the like. The connectors 24 may be positioned around an outer perimeter of the frame 16.

A cover 26 may be formed around the frame 16. The cover 26 may be used to allow the frame 16 to match the golf bag 14A so that the frame 16 is not shown. The cover 24 may be a padded vinyl material, leather material, or the like. The listing of the above is given as an example and should not be seen in a limiting manner.

Figure 4:
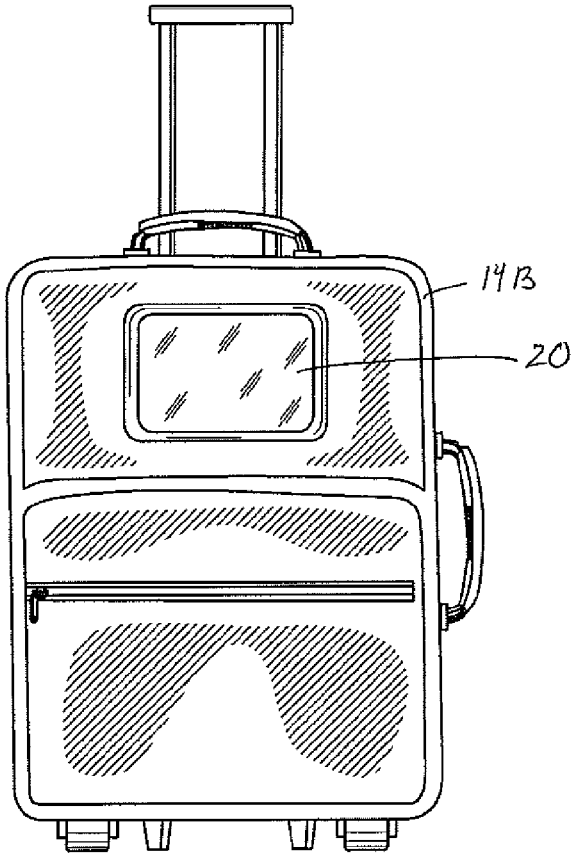
FIG. 4 is a perspective view of the device of FIG. 1 being used with a suitcase.

Referring now to FIG. 4, the device 10 is shown installed on a piece of luggage 14B. In this embodiment, the frame 16 used in the previous embodiment may be used to mount the display screen 20 to a front storage compartment of the piece of luggage 14B. The frame 16 has the same basic structure as in the previous embodiment.

Figure 5:
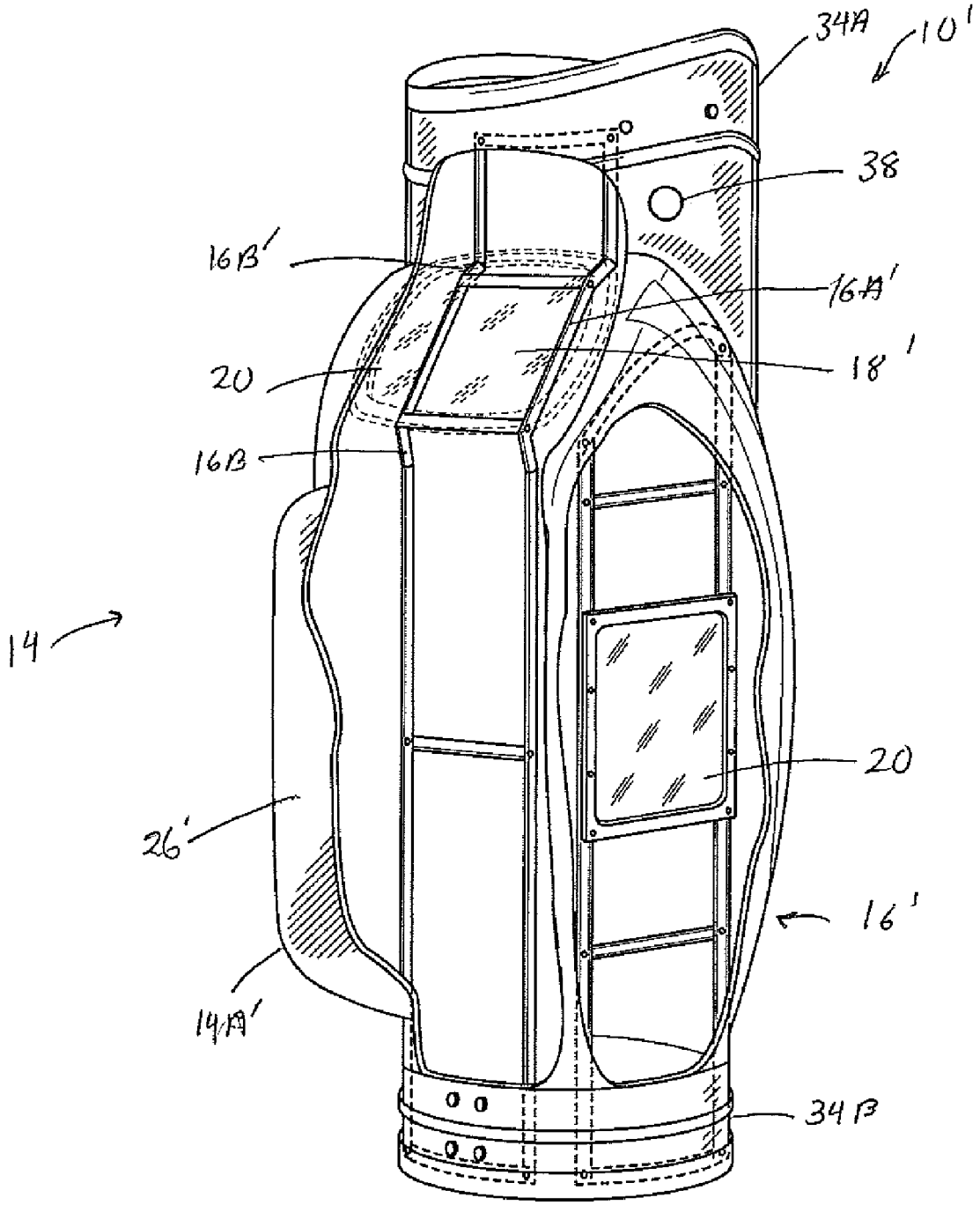
FIG. 5 is a perspective view of another embodiment of the device which allows for multiple screens to be installed, the device configured to be used with a golf bag.

Referring now to FIG. 5, a device 10' for securing a plurality of video display screens 20 to a golf bag, suit case, or other type of carrying case (hereinafter bag 14) is shown. In the embodiment shown in FIG. 5, the device 10' is shown installed on a golf bag 14A. The description below will be discussed in relation to a golf bag 14A. However, the device may be installed in other types of carrying and or wheeled cases without departing from the spirit and scope of the present invention.

The device 10' has a frame 16' which may be used to allow a plurality of display screens 20 to be installed. In the present embodiment, the frame 16' is designed to define a shape of the golf bag 14A. The frame 16' may be formed of a light weight but sturdy material. For example, the frame 16' may be comprised of a light weight metal such as aluminum or titanium, carbon fiber, or a light weight plastic material. The listing of the above is given as examples and should not be seen in a limiting manner.

The frame 16' may be comprised of a plurality of approximately planer plate members 16A'. The plate member 16A' may be formed of a thin sheet of aluminum, plastic, or the like. The plate member 16A' may have an opening 18' formed therein. In general, the opening 18' may be formed in a central area of the plate member 16A'. The opening 18' is sized to allow a display screen 20 to be mounted therein.

The display screens 20 may be a Liquid Crystal Display (LCD), a Light Emitting Diode (LED) display, an Organic Light Emitting Diode (OLED) display or the like. The listing of the above is given as an example and should not be seen in a limiting manner. The display screen 20 may be of various sizes. The opening 18 may be sized to conform to the size and depth of the particular display screen 20 used. In accordance with one embodiment, the display screen may range in width from 4 to 12 inches, and may have a height ranging from 2.5 to 15 inches, with a depth of 0.25 to 2.25 inches, and varying in weight from 8 to 80 ounces. The display screen 20 may have various resolutions. In accordance with one embodiment, the display screen may have a resolution of 320×640 to 1920×1080.

The display screen 20 may be used to show different advertisements. The advertisements may be static or dynamic ads. The display screen 20 may be used to show a plurality of different advertisements on a rotating basis wherein different ads may be shown after a predetermined time frame.

As in the previous embodiment, the display screen 20 may have a memory storage device 30 (FIG. 2). The memory storage device 30 may be built in to the display screen 20, an external device or the like. The memory storage device may be a device such as a CF card, an SD card, an XD card, MMC card, MS card, MSpro card, a USB device or the like. The listing of the above is given as an example and should not be seen in a limiting manner. The memory storage device may be used to store different advertisements to be shown on the display screen 20. The memory storage device 30 may be used to store photo files such as but not limited to: PEG, BMP, TIFF, PNG, GIF and the like; video files such as but not limited to MJPEG, MPEG1, MPEG2 , MPEG4, AVI, WMV, MOV, and the like; audio files such as but not limited to: MP4, WAV, MP3, and the like. Speakers or the like may be built in to the display screen 20 or external to the display screen 20. The speakers may be used to play any audio files or audio on the video and or picture files.

The display screen 20 may have a built-in accelerometer 32 (FIG. 2). The built-in accelerometer 32 may be used to sense position, vibration and shock on the display screen 20. By sensing position, the accelerometer 32 may be used to rotate the advertisement on the display screen 20 based on the position of the golf bag 14A.

A camera 38 may be coupled to the frame 16'. The camera may be positioned near the display screen 20. The camera 38 may be used to capture images to see if people are looking at the display screen 20. The camera 38 may thus be used to determine the effectiveness of the device 10. The video from the camera 38 may be stored on a memory device. The memory device may have software to monitor eye contact with the camera 38.

A power source 28 (FIG. 2) may be coupled to the display screen 20. The power source 28 may be coupled to a back surface of the frame 16 as shown in FIGS. 2 and 3. The power source 28 may be used to illuminate the display screen 20. The power source 28 may be battery, rechargeable battery, a solar panel device, combinations thereof, or the like.

One or more display attachment devices 22 (FIG. 2) may be used to secure the display screen 20 to the plate member 16A. The display attachment devices 22 may be any type of securing device which is able to secure the display screen 20 to the plate member 16A. In the embodiment shown in FIGS. 2-3, the attachment device 22 is a bracket 22A (FIG. 2). The bracket 22A may be a U shaped bracket which fits behind the display screen 20 to secure the display screen 20 to the plate member 16A. In the embodiment shown in FIGS. 2-3, a pair of brackets 22A may be used. However, this is shown as an example and should not be seen in a limiting manner. The brackets 22A may be aluminum, hook and loop material, rubber, lightweight plastic, magnets, or the like. The listing is given as an example and should not be seen in a limiting manner.

Extending from two ends of the plate member 16A' may be a pair of support arms 16B'. The support arms 16B' may be used to secure the frame 16' to the golf bag 14A'. In the present embodiment, some of the support arms 16B' may extend straight away from the plate member 16A' while other support arms 16B' may extend down and away from the plate member 16A'. The angle of the support arms 16B' depends on where the plate member 16A' and the shape of the golf bag 14A'. By extending down and away from the plate member 16A', the support arms 16B' may be used to elevate the plate member 16A' and thus the display screen 20 to the plate member 16A'. Further, by extending down and away from the plate member 16A', frame 16' is contoured to conform to the shape of the golf bag 14A'.

Attached to a distal end of each support arm 16B' may be one of a top end member 34 or a bottom end member 36. The top end member 34 and the bottom end member 36 may be used to form the shape of the golf bag 14A' as well as the size of an opening in the top of the golf bag 14A'.

A cover 26' may be formed around the frame 16'. The cover 26' may be used to enclose and cover the frame 16 to form the golf bag 14A. The cover 24' may be a padded vinyl material, leather material, or the like. The listing of the above is given as an example and should not be seen in a limiting manner.

This disclosure provides exemplary embodiments of the present invention. The scope of the present invention is not limited by these exemplary embodiments. Numerous variations, whether explicitly provided for by the specification or implied by the specification, such as variations in structure, dimension, type of material and manufacturing process may be implemented by one of skill in the art in view of this disclosure.

What is claimed is:

1. A device for displaying advertisements comprising:
a golf bag;
a frame mounted to an interior of the golf bag, wherein the frame comprises:
a plate member;
an opening formed in the plate member, wherein the opening is sized to fit a display;
support arms coupled to the plate member, the support arms extend down and away from the plate member to conform to a shape of the golf bag, for securing the device to the golf bag to which the device is installed.

2. A device for displaying advertisements in accordance with claim 1, further comprising:
a display positioned in the opening; and
at least one bracket positioned across the opening of the plate member to secure the display in the opening.

3. A device for displaying advertisements in accordance with claim 2, further comprising a memory storage device coupled to the display.

4. A device for displaying advertisements in accordance with claim 2, further comprising a power supply coupled to the display.

5. A device for displaying advertisements in accordance with claim 4, wherein the power supply is one of a battery, a solar panel, or combinations thereof.

6. A device for displaying advertisements in accordance with claim 2, further comprising at least one speaker coupled to the display.

7. A device for displaying advertisements in accordance with claim 2, further comprising a camera positioned near the display.

8. A device for displaying advertisements in accordance with claim 2, further comprising a covering placed over the plate member and support arms that are exposed.

9. A device for displaying advertisements comprising:
a golf bag;
a top frame member;
a bottom frame member, wherein the top frame member and bottom frame define a shape of the golf bag;
a plurality of support arms coupled to the top and bottom frame members, wherein at least one set of the support arms extend down and away from the plate member to conform to the shape of the golf bag;
a plurality of plate members coupled to at least one of the support arms;
an opening formed in the plate members, wherein the opening is sized to fit a display screen of a desired dimension; and
a display screen positioned in the opening.

10. A device for displaying advertisements in accordance with claim 9, further comprising at least one bracket positioned across the opening of the plate member.

11. A device for displaying advertisements in accordance with claim 9, further comprising a power supply coupled to the display.

12. A device for displaying advertisements in accordance with claim 9, further comprising an accelerometer coupled to one of the top frame member or the bottom frame member to sense movement of the device and to change advertisements based on the movement.

13. A device for displaying advertisements in accordance with claim 9, further comprising at least one speaker coupled to the display.

14. A device for displaying advertisements in accordance with claim 9, further comprising a camera positioned near the display.

15. A device for displaying advertisements on a piece of baggage comprising:

a golf bag;

a top frame member;

a bottom frame member, wherein the top frame member and bottom frame define a shape of the golf bag;

a plurality of support arms coupled to the top and bottom frame members;

a plurality of plate members coupled to at least one of the support arms;

an opening formed in the plate members, wherein the opening is sized to fit a display screen of a desired dimension;

a display positioned in the opening;

at least one bracket positioned across the opening of the plate members to secure the display in the opening; and a memory storage device coupled to the display screen for storing images to be shown on the display;

wherein one set of the plurality of support arms extend down and away from at least one of the plate members to further define the shape of the piece of baggage.

16. A device for displaying advertisements in accordance with claim 15, further comprising a power supply coupled to the display.

17. A device for displaying advertisements in accordance with claim 16, wherein the power supply is one of a battery, a solar panel, or a combination thereof.

18. A device for displaying advertisements in accordance with claim 15, further comprising at least one speaker coupled to the display.

19. A device for displaying advertisements in accordance with claim 15, further comprising a camera positioned near the display.

* * * * *